US007677906B2

(12) United States Patent
Luettermann et al.

(10) Patent No.: US 7,677,906 B2
(45) Date of Patent: Mar. 16, 2010

(54) PRINTED BOARD CONNECTOR WITH GROUND CONNECTION

(75) Inventors: Dieter Luettermann, Rahden (DE); Guenter Pape, Enger (DE)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 12/364,401

(22) Filed: Feb. 2, 2009

(65) Prior Publication Data

US 2009/0209114 A1 Aug. 20, 2009

(30) Foreign Application Priority Data

Feb. 16, 2008 (DE) ..... 20 2008 002 149 U

(51) Int. Cl.
*H01R 12/00* (2006.01)

(52) U.S. Cl. ..... 439/108; 439/59

(58) Field of Classification Search ..... 439/92, 439/108, 64, 377, 59, 60, 62
See application file for complete search history.

(56) References Cited

U.S. PATENT DOCUMENTS 3,926,496 A * 12/1975 Occhipinti ..... 439/377
4,025,147 A * 5/1977 Van Arsdale et al. ..... 439/634
4,377,315 A * 3/1983 Grau ..... 439/59
4,574,332 A * 3/1986 Calabro ..... 361/791
4,614,389 A * 9/1986 Albert et al. ..... 439/144
4,776,805 A * 10/1988 Brown et al. ..... 439/64
4,864,458 A * 9/1989 Demorat et al. ..... 361/212
4,955,817 A * 9/1990 Sugai ..... 439/60
5,357,402 A * 10/1994 Anhalt ..... 361/753
5,398,154 A * 3/1995 Perkins et al. ..... 361/212
5,653,596 A * 8/1997 Banakis et al. ..... 439/64
7,503,796 B2 * 3/2009 Luettermann et al. ..... 439/377

* cited by examiner

*Primary Examiner*—Neil Abrams
(74) *Attorney, Agent, or Firm*—Hayes Soloway P.C.

(57) ABSTRACT

In a board-edge connector designed for directly contacting a printed board includes a ground connection between the printed board and the connector which engages before the printed board is completely mated and connected to the voltage supply. A grounding contact is arranged in one of the corner regions within the plug-in slot of the printed board connector, wherein the grounding contact is connected to a grounding strip on the printed board on which the printed board connector is fixed. During the mating process, the printed board, onto which a grounding strip is applied on at least one of the lateral edges within the mating region, slides past the grounding contact such that an electrostatic equalization between the printed board to be newly inserted and the connector takes place before the contacting of the remaining electric contacts.

6 Claims, 7 Drawing Sheets

PRINTED BOARD CONNECTOR WITH GROUND CONNECTION

BACKGROUND OF THE INVENTION

1. Field of the Invention

The invention pertains to a printed board connector, particularly a board-edge connector, with a plug-in slot, in which electric contact elements for directly pluggable printed boards are arranged.

A connector of this type is required in order to ensure a safe ground connection between the printed board and the connector in addition to a mechanically exact guidance of a printed board in a printed board connector.

2. Description of the Related Art

Various devices are known from the prior art for contacting a printed board with a connector in such a way that a potential equalization initially takes place during the mating process before the voltage supply of the printed board is realized.

For example, printed boards are provided with locking mechanisms that de-activate the voltage supply before the connector is pulled out and only activate the voltage supply during the mating process by means of a microswitch after the connector is completely inserted and locked.

Known connectors of this type naturally are correspondingly complex with respect to their construction and manufacture.

SUMMARY OF THE INVENTION

The invention therefore is based on the objective of realizing a device of the initially cited type in such a way that a ground connection is produced between the printed board and a connector in order to ensure a safe discharge, if applicable, of static electric energy before the printed board is completely mated and connected to the voltage supply.

This objective is attained in that an electrically conductive grounding contact is arranged within the plug-in slot in at least one of the corner regions of the connector, in that a printed board inserted into the plug-in slot features a grounding strip on at least one lateral edge facing the grounding contact within a mating region of the printed board, and in that the grounding strip slides along the grounding contact in a contacting fashion during the insertion of the printed board into the plug-in slot.

The shielding of electronic components in rack-systems (switchgear cabinets) against electromagnetic interferences is usually realized with completely shielded housings. In this case, each module housing in the rack system is also completely shielded.

Since it is rarely possible to switch off the entire system if it becomes necessary to exchange a printed board in one of the module housings, it needs to be ensured that such an exchange can take place without any problems.

This makes it necessary to prevent uncontrolled discharges of static electric energy by ensuring that a potential equalization between the grounded lines of the new printed board and the system initially takes place during the mating process before the other contacts of the connector are electrically contacted during the additional insertion of the printed board.

To this end, the inventive printed board connector features a specially shaped grounding contact at least on one of its corner regions.

The grounding contact represents a separate component that is integrated into the connector housing and terminates the plug-in slot, along which the printed board advantageously slides during the insertion, on one end by means of said connector housing.

The grounding contact consists of an electrically conductive material, preferably of massive metal, that is snapped into the non-conductive connector housing and advantageously features an electrically conductive connection to the printed board, on which the connector housing is fixed. In this case, several variations are provided for contacting the contact with a corresponding grounded strip conductor on the printed board. This can be realized by means of spring-type contacting, e.g., with a solder pin or a press-in pin.

A connection from or through the printed board into a corresponding bore (possibly with a thread) in the grounding contact is also provided.

In one variation, a grounding contact is provided that is realized in the form of an electrically conductive press-bent part and once again features an electric connection to a grounded strip conductor on the printed board, on which the printed board connector is fixed.

In order to realize optimal ground contact, it is proposed that the printed board to be inserted into the printed board connector is provided with a grounded strip conductor to be arranged on the board edge so as to directly contact the grounding contact.

In this case, the grounded strip conductor needs to be provided on the lateral edges of the printed board at least in the immediate mating region.

In this case, the grounding strip may be applied by means of electroplating or realized in the form in metallic surface to be applied separately and extends around the outer edge in an angular or U-shaped fashion, namely on a side that faces the ground connection.

Another advantage can be seen in that a thusly equipped printed board connector withstands high mating cycles because the relatively sharp printed board edges in connection with the surface of the printed board edges that are more and less rough depending on the manufacturing quality causes higher friction on the commonly used plastic wall in the two corner regions such that it is subjected to increased wear.

BRIEF DESCRIPTION OF THE DRAWINGS

One embodiment of the invention is illustrated in the figures and described in greater detail below. The figures show.

DESCRIPTION OF THE PREFERRED EMBODIMENTS

Figure 1:
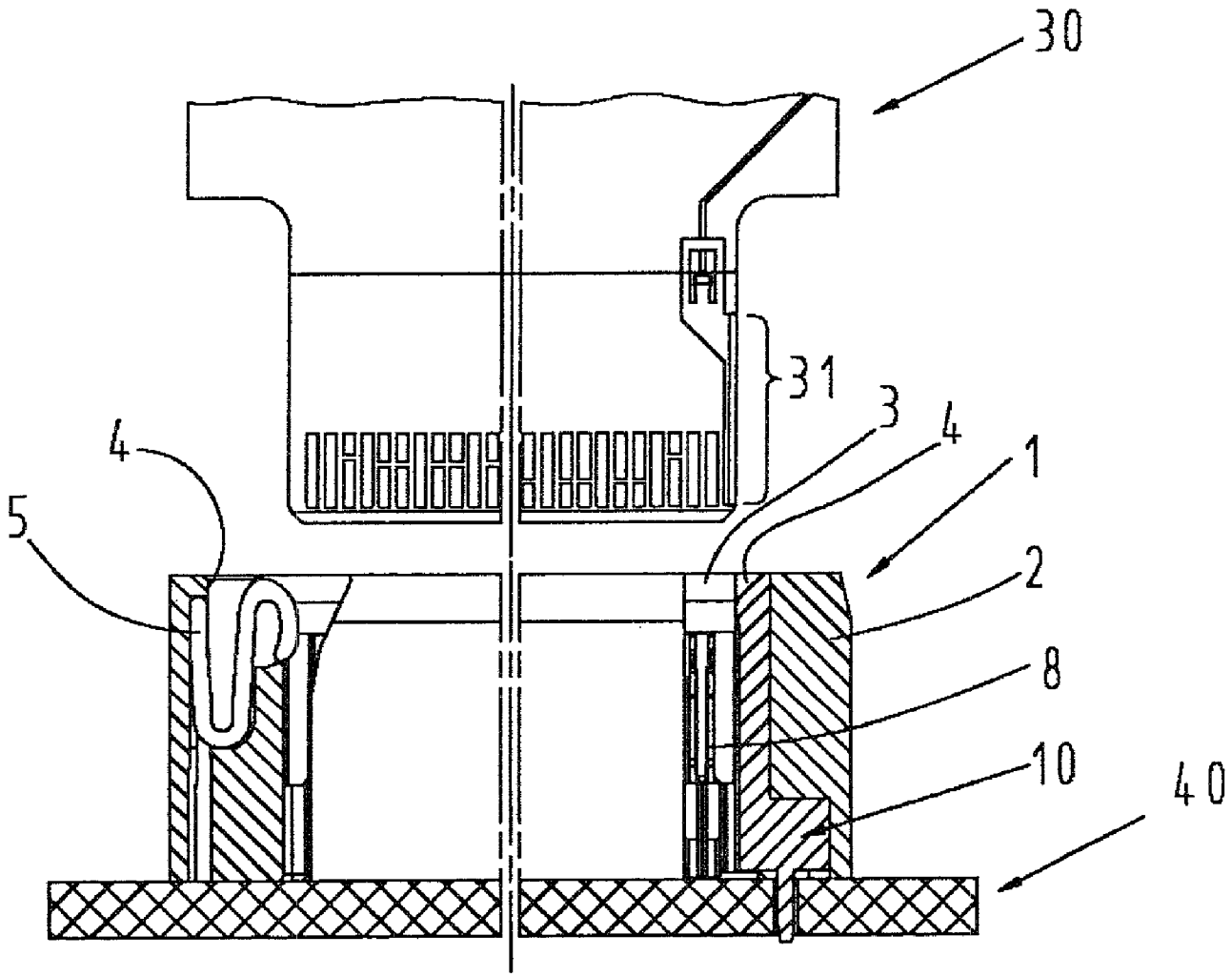
FIG. 1 a partial section through a printed board connector, in which a grounding contact is installed.

FIG. 1 shows a partial section through a printed board connector 1 that is mounted on a printed board 40 and features electric contact elements 8 and a grounding contact 10.

The printed board connector 1 features a connector housing 2 with a plug-in slot 3 for directly contacting a printed board 30.

In addition, an S-shaped pressure spring 5 is inserted into the plug-in slot 3 on the side that lies opposite of the grounding contact 10, wherein the printed board 30 is immediately pressed 10 against the grounding contact 10 during the mating process by means of said pressure spring, namely without already contacting an electric contact of the printed board and the connector.

Figure 2C:
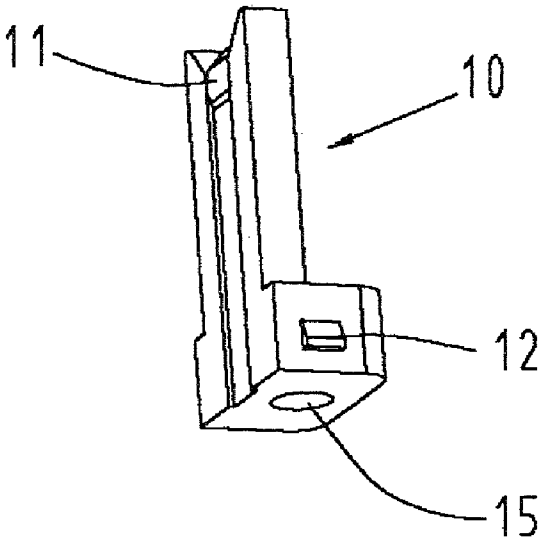
FIG. 2*c* a metallic grounding contact with a bore for a pin.
Figure 2B:
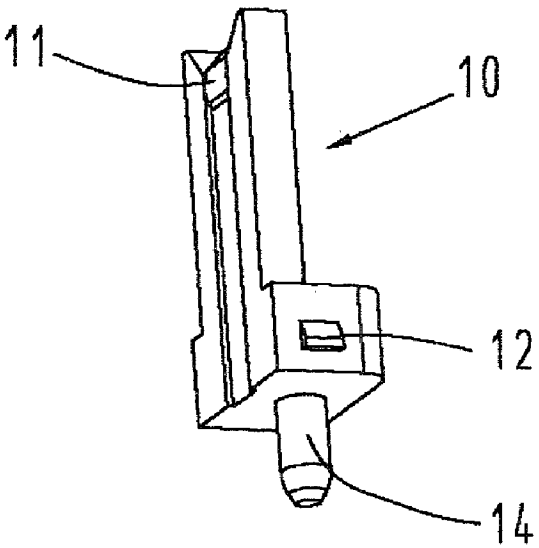
FIG. 2*b* a metallic grounding contact with a solder pin.
Figure 2A:
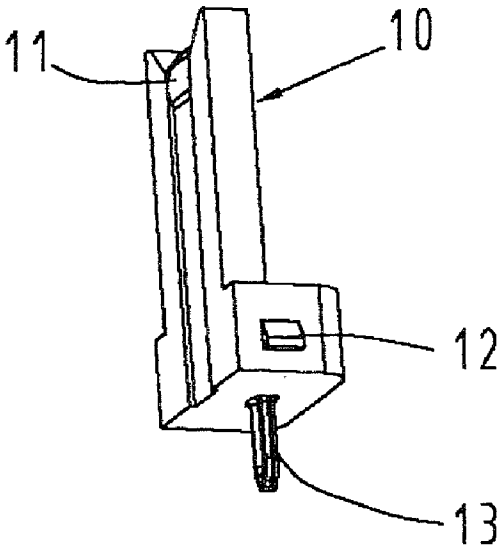
FIG. 2*a* a metallic grounding contact with a press-in pin.

The first variation of the grounding contact 10 is illustrated in FIG. 2. This figure shows a massive metallic contact that is equipped with a press-in contact 13 in FIG. 2*a*, with a solder-in contact 14 in FIG. 2*b* and with a bore 15 in FIG. 2*c*.

The body shape indicates a slightly L-shaped design with a dome 11 provided for contacting a printed board 30.

Two retaining tabs 12 are integrally molded onto the foot region of the grounding contact 10 in order to realize the engagement in the connector housing 2.

Figure 3:
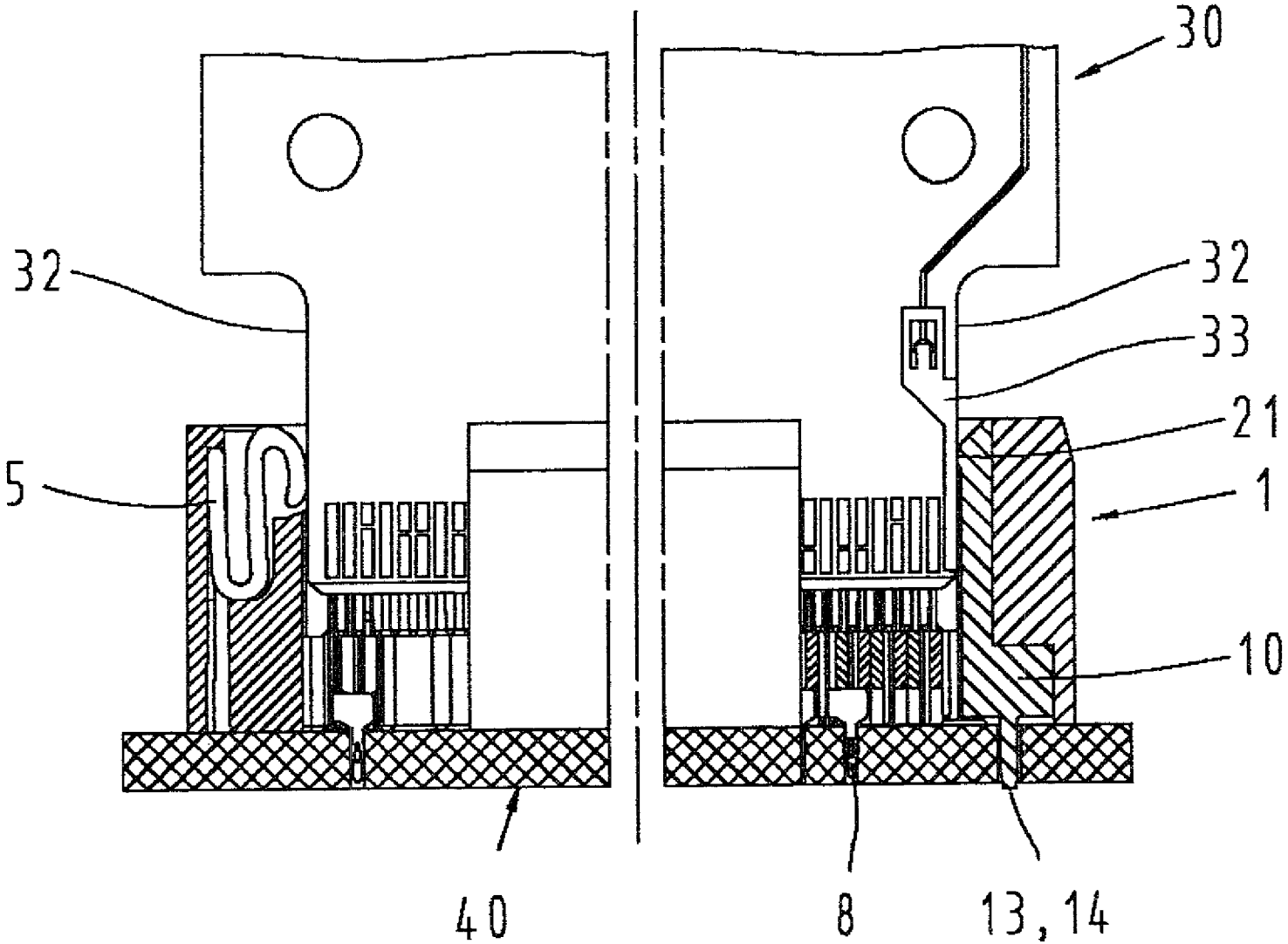
FIG. 3 a section through a printed board connector that is fixed on a printed board, as well as a printed board that is partially inserted into said connector.

FIG. 3 shows a printed board 30 with a grounding contact 10 that is half-way inserted into the printed board connector 1.

According to this figure, the pressure spring 5 that presses the printed board 30 against the grounding contact 10 is arranged in the corner region opposite of the grounding contact 10.

Figure 4:
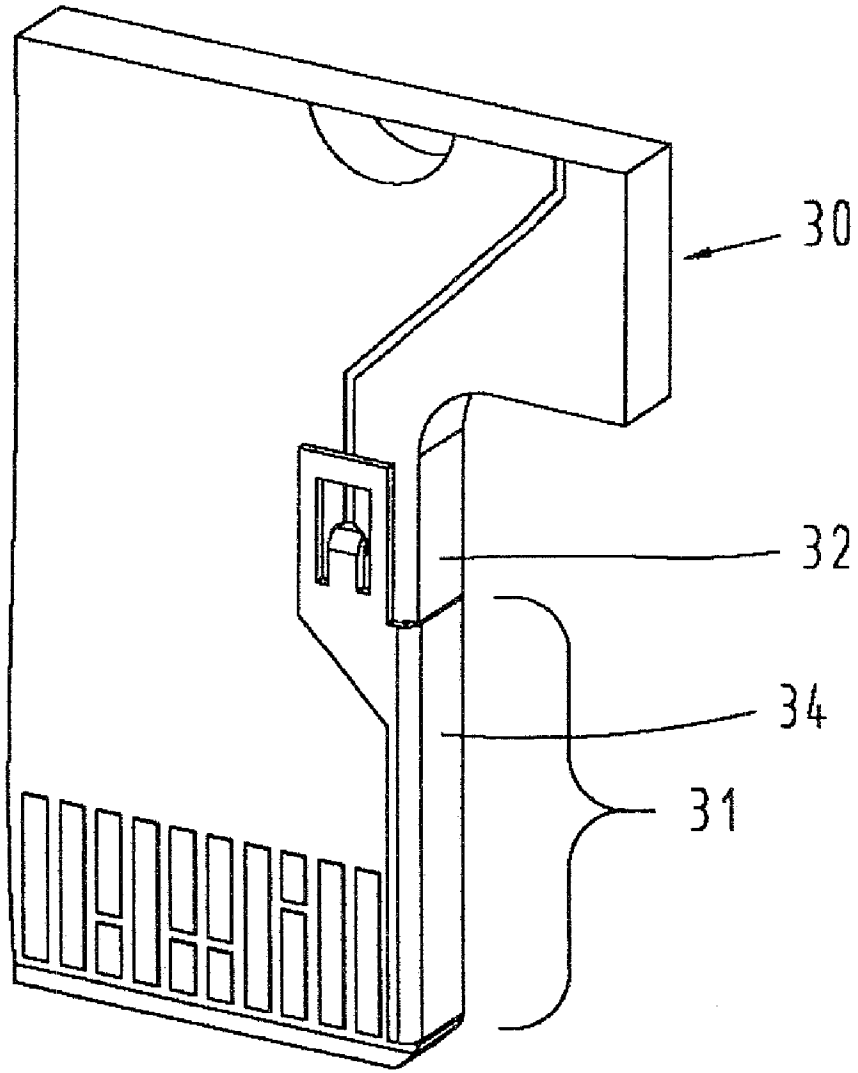
FIG. 4 a detail of the mating region of the printed board with an angled grounding strip.

In this case, the actual purpose of the pressure spring 5 consists of guiding together the contacts that are arranged very closely adjacent to one another in this system in a precisely fitted fashion—namely before the contacts contact one another during the insertion of the printed board 30 into the printed board connector 1. A grounding strip 33 illustrated on the printed board 30 in the mating region 31 also extends over the lateral edge of the printed board, on which it is applied by means of electroplating or separately fixed in the form of an angled sheet metal part 34 as shown in FIG. 4.

Figure 5:
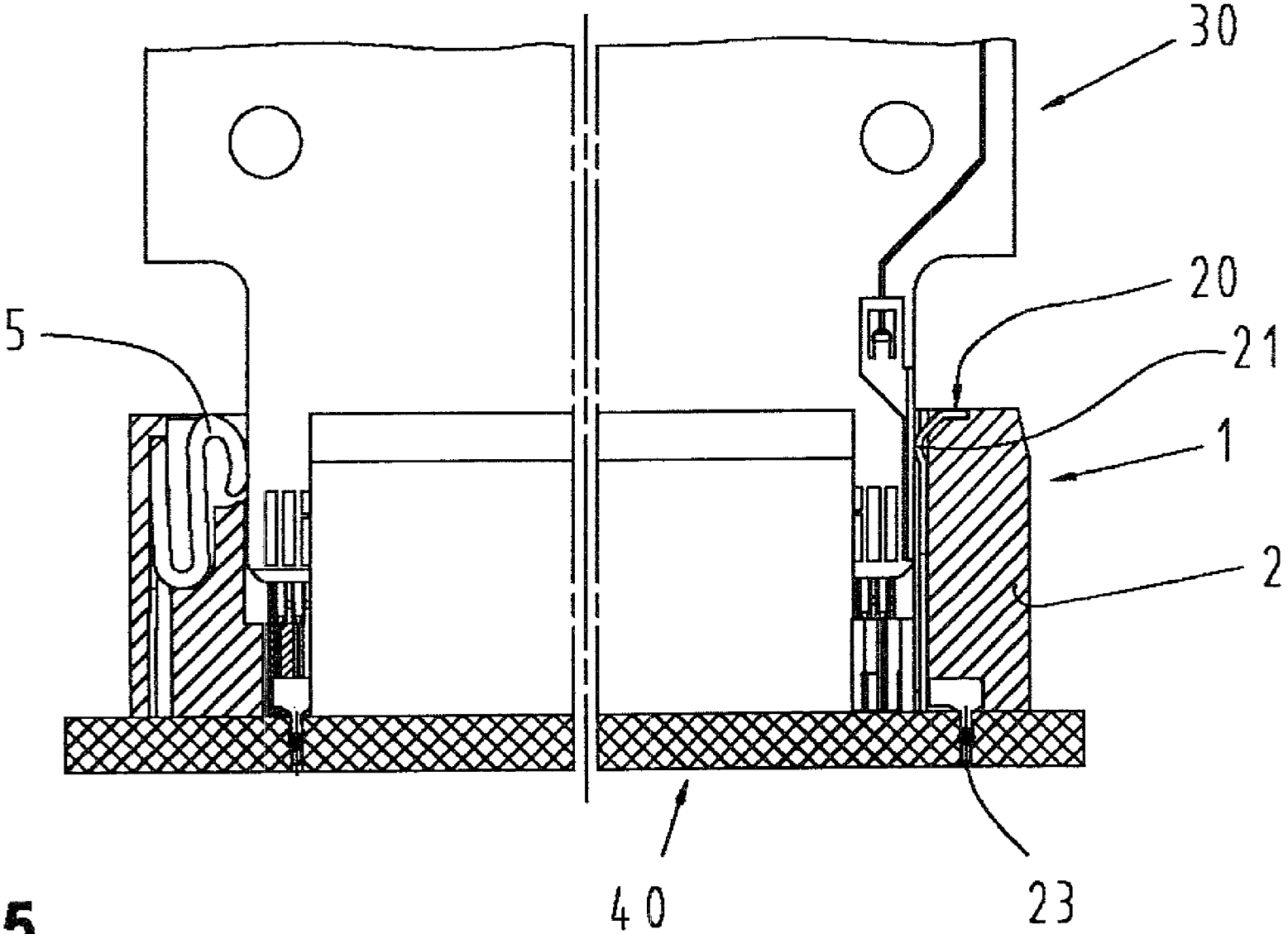
FIG. 5 a section through a printed board connector that is mounted on a printed board, as well as a printed board that is inserted into said connector and a grounding element that is realized in the form of a press-bent part.

FIG. 5 shows the printed board connector 1 with a grounding contact 20 that is realized in the form of a punched and angled contact rail. This arrangement is, in principle, also equipped with a contact dome 21 for realizing the contacting with one of the grounded lateral surfaces of the printed board. Lateral retaining hooks 22 are provided for a secure retention within the connector housing.

Analogous to the pin-like grounding contact 10, the connection to a grounding strip on the printed board 40, on which the printed board connector 1 is fixed, is realized with the aid of a press-in or soldered connection 23. A spring-type contact 24 similar to that shown in FIG. 6 may also be provided for this purpose.

Figure 6:
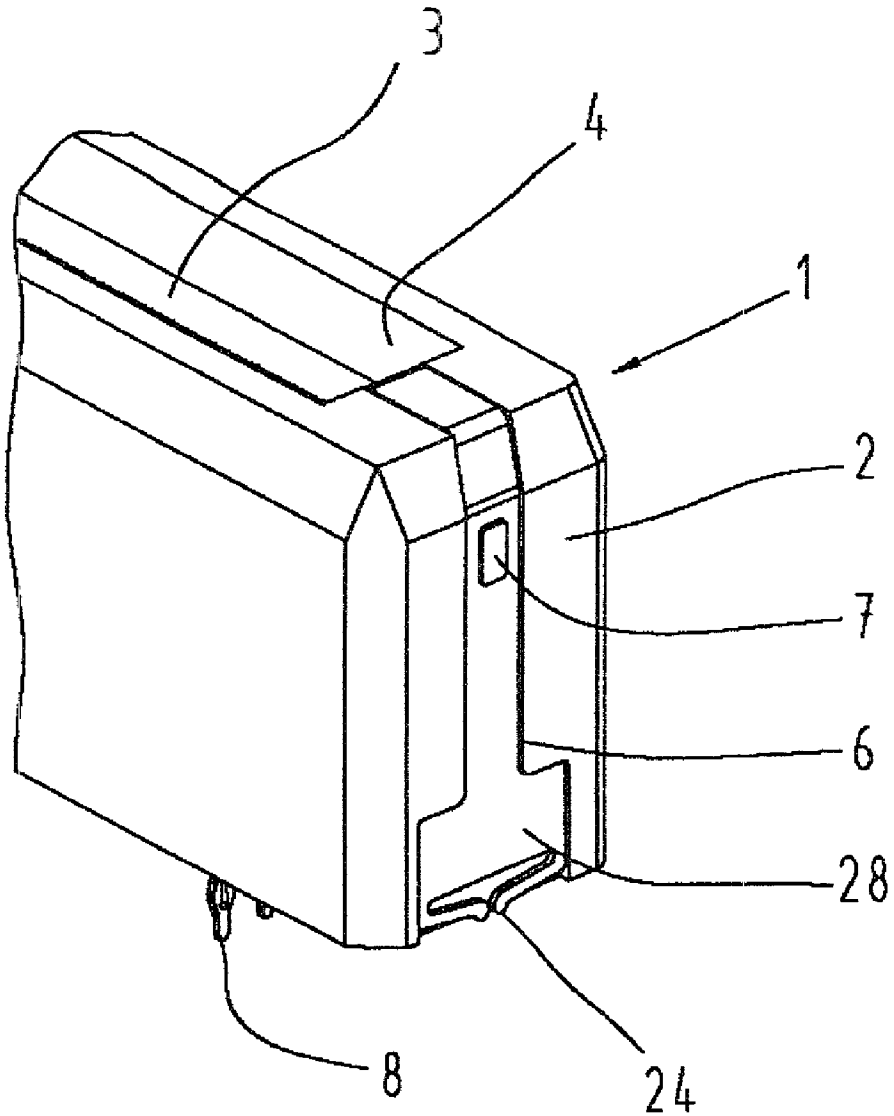
FIG. 6 part of a printed board connector with a grounding contact that can be externally attached thereon, and FIG. 7 different variations of a grounding contact realized in the form of a press-bent part.

FIG. 6 shows a printed board connector, in which the grounding contact 28 is realized in the form of a punched metal strip that is adapted to the exterior shape of the housing and attached to the connector housing 2 from outside, namely in a correspondingly shaped recess 6. In this case, the contact is realized in the form of an asymmetric U and latched on one of the corner regions 4 in the region of the plug-in slot 3 with the shorter limb such that it contacts the dome 21 of an inserted printed board 30 and subsequently engaged from outside on a retaining knob 7 on the connector housing 2 provided for this purpose.

The contact region that then points toward the printed board 40 is either realized SMD-compatible for soldering or—as shown in the figure—with spring-loaded contacts 24 for being pressed on a grounded strip conductor of the printed board 40.

FIG. 7 shows several variations of the punched, angled grounding contacts 20, 20', 28 required in or on one of the corner regions 4 of the printed board connector 1 in order to contact an inserted printed board 30.

Figure 7C:
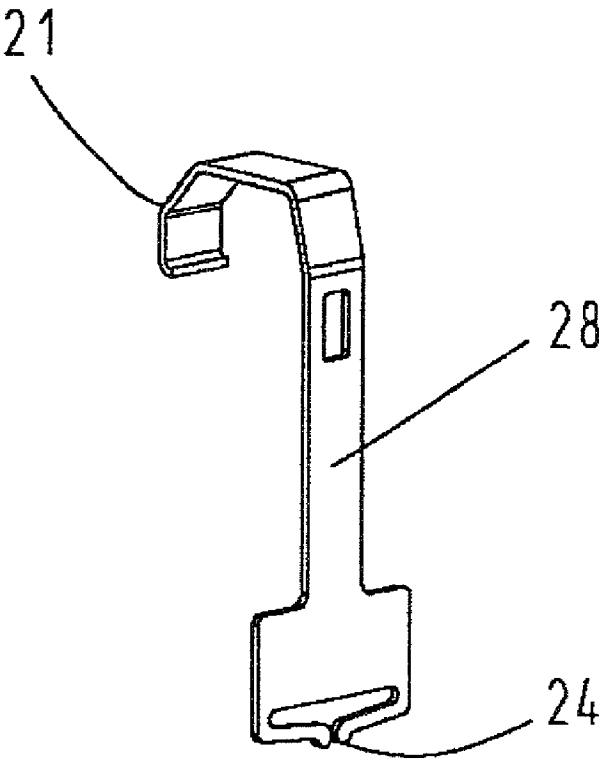
Figure 7B:
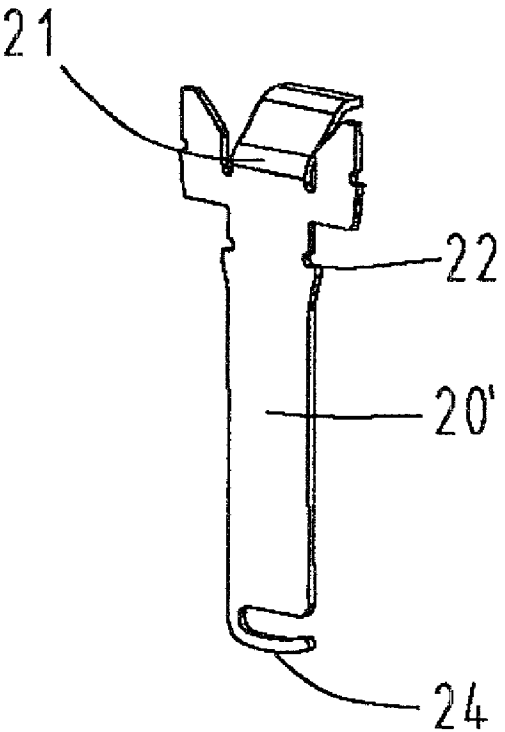
Figure 7A:
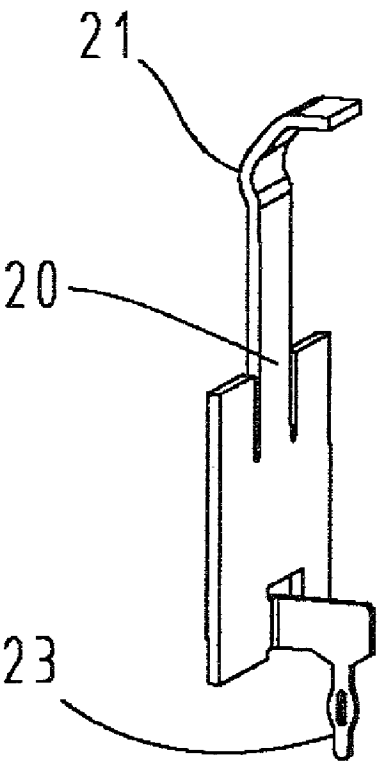

FIG. 7*a* shows the punched, angled grounding contact 20 that is intended for use inside the connector housing 2. This grounding contact features a slightly wider sheet metal section, from which a solder pin 23 angularly protrudes, as well as a narrower sheet metal section that features a dome 21 for contacting the printed board 30.

FIG. 7*b* shows a variation of an internal contact 20' that can be engaged in the connector housing 2 by means of two retaining hooks 22 and is designed for contacting a strip conductor on the printed board 40 in a spring-loaded fashion.

FIG. 7*c* shows a grounding contact 28 that can be attached to the outside of the connector housing 2. The press-bent part 10 is inserted into a recess 6 of the connector housing 2 and engaged therein by means of an integral retaining knob 7. This variation features two spring-type contacts 24 for contacting a grounded strip conductor on the printed board 40.

What is claimed is:

1. A printed board connector, particularly a board-edge connector, with a plug-in slot, for connecting a first board to a second board, in which electric contact elements for directly pluggable printed boards are arranged, wherein an electrically conductive grounding contact having a contact dome is arranged within the plug-in slot in a corner region of the connector along one side of the slot, and an S-shaped pressure spring is arranged within the plug-in slot along a side of the slot opposite the side with the electrically grounding contact region, the first board inserted into the plug-in slot includes a grounding strip on at least one lateral edge facing the grounding contact within a mating region of the first board, and the grounding strip slides along the contact dome grounding contact in a contacting fashion during the insertion of the first board into the plug-in slot.

2. The printed board connector according to claim 1, wherein the grounding contact is pin-shaped and includes an electrically conductive ground connection to the second board, on which the printed board connector is fixed.

3. The printed board connector according to claim 1, wherein the contact is in the form of an embossed grounding contact.

4. The printed board connector according to claim 1, wherein the grounding contact contacts a grounded strip conductor on the first board by a press-in pin or by a solder-in pin or by a spring-type contact.

5. The printed board connector according to claim 1, wherein a grounding strip formed of a contact element that encompasses the lateral edge is provided on at least one of the lateral edges in the mating region of the first board.

6. The printed board connector according to claim 1, wherein a grounding strip in the form of a structure applied by electroplating is provided on at least one of the lateral edges in the mating region of the first board.

* * * * *